US010047418B2

(12) United States Patent
Chang et al.

(10) Patent No.: US 10,047,418 B2
(45) Date of Patent: Aug. 14, 2018

(54) METHOD FOR MANUFACTURING HIGH-STRENGTH AND HIGH-DUCTILITY STEEL

(71) Applicant: CHINA STEEL CORPORATION, Kaohsiung (TW)

(72) Inventors: Chih-Pu Chang, Kaohsiung (TW); Delphic Chen, Kaohsiung (TW); Chih-Hung Ou, Kaohsiung (TW); Jui-Fan Tu, Kaohsiung (TW); Kuo-Cheng Yang, Kaohsiung (TW); Lung-Jen Chiang, Kaohsiung (TW); Ming-Chin Tsai, Kaohsiung (TW)

(73) Assignee: CHINA STEEL CORPORATION, Kaohsiung (TW)

( * ) Notice: Subject to any disclaimer, the term of this patent is extended or adjusted under 35 U.S.C. 154(b) by 111 days.

(21) Appl. No.: 14/796,318

(22) Filed: Jul. 10, 2015

(65) Prior Publication Data

US 2016/0222494 A1 Aug. 4, 2016

(30) Foreign Application Priority Data

Jan. 30, 2015 (TW) ..... 104103334 A

(51) Int. Cl.
*C21D 8/02* (2006.01)
*C22C 38/06* (2006.01)
(Continued)

(52) U.S. Cl.
CPC ..... *C22C 38/06* (2013.01); *C21D 6/005* (2013.01); *C21D 6/008* (2013.01); *C21D 8/005* (2013.01);
(Continued)

(58) Field of Classification Search
CPC ..... C21D 8/005; C21D 8/02
(Continued)

(56) References Cited

U.S. PATENT DOCUMENTS 5,470,529 A * 11/1995 Nomura ..... C21D 8/0226 148/320
6,544,354 B1 * 4/2003 Kawano ..... C21D 8/0226 148/320
(Continued)

FOREIGN PATENT DOCUMENTS

CN 101120114 A 2/2008
WO WO2012/077150 A2 6/2012
WO WO2013/047819 A1 4/2013

OTHER PUBLICATIONS

Search Report dated May 4, 2015 for the corresponding Taiwan Patent Application No. 104103334.
(Continued)

*Primary Examiner* — Brian Walck
(74) *Attorney, Agent, or Firm* — WPAT, P.C., Intellectual Property Attorneys; Anthony King

(57) ABSTRACT

A method for manufacturing a high-strength and high-ductility steel includes steps in which an alloy steel is provided. The method continues with step in which the alloy steel is hot rolled, so that the microstructure of the alloy steel includes austenite, bainite and martensite. The method continues with step in which the hot-rolled alloy steel is annealed, so as to decompose bainite and martensite structures of the alloy steel into ferrite and austenite structures. The method continues with step in which the annealed alloy steel is cold rolled. The method continues with step in which the cold-rolled alloy steel is annealed, so as to manufacture a high-strength and high-ductility steel in a phase with 50% to 70% of residual austenite.

4 Claims, 3 Drawing Sheets

(51) Int. Cl.

| | |
|---|---|
| ***C21D 8/00*** | (2006.01) |
| ***C21D 6/00*** | (2006.01) |
| ***C22C 38/04*** | (2006.01) |
| ***C22C 38/02*** | (2006.01) |

(52) U.S. Cl.
CPC ..... *C21D 8/02* (2013.01); *C22C 38/02* (2013.01); *C22C 38/04* (2013.01)

(58) Field of Classification Search
USPC ..... 148/504, 579, 651
See application file for complete search history.

(56) References Cited

U.S. PATENT DOCUMENTS

| | | | | |
|---|---|---|---|---|
| 2014/0158257 | A1 | 6/2014 | Frehn et al. | |
| 2016/0222494 | A1 * | 8/2016 | Chang | C22C 38/06 |

OTHER PUBLICATIONS

English translation of the Search Report dated May 4, 2015 for the corresponding Taiwan Patent Application No. 104103334.

* cited by examiner

METHOD FOR MANUFACTURING HIGH-STRENGTH AND HIGH-DUCTILITY STEEL

FIELD

The disclosure relates to a method for manufacturing a steel, more particularly to a method for manufacturing a high-strength and high-ductility steel.

BACKGROUND

In order to deal with the demands of energy conservation and carbon reduction in recent years, the automobile industry is committed to reduce the weights of automobile bodies, so as to reduce fuel consumption to achieve the purposes of energy conservation and carbon reduction.

A conventional effective way to reduce the weights of automobile bodies is to thin thicknesses of steels used in automobile bodies; however, safety of the automobile bodies cannot be sacrificed during thicknesses thinning of the steels. Therefore, it is necessary to further enhance strength and ductility of the steels used in automobiles.

Over the past few years, the steel industry has developed the so-called 1st generation and 2nd generation advanced high strength steels (AHSSs). The 1st generation AHSSs mainly refer to transformation induced plasticity (TRIP) steels, the tensile strength thereof is about between 600 MPa and 1000 MPa, the elongation thereof is between 20% and 40%, and the strength-elongation product (i.e., the product of the tensile strength and the elongation) is less than 20 GPa %. Because the tensile strength and the elongation of the TRIP steels are lower than those required in the automobile industry, development of the 2nd generation AHSSs emerges.

The 2nd generation AHSSs mainly refer to twinning induced plasticity (TWIP) steels, which belong to high manganese alloy steels, and the manganese content is about between 20 wt % and 30 wt %. The TWIP steels have excellent strength, the tensile strength thereof is about between 600 MPa and 1100 MPa, and the elongation thereof can be maintained between 60% and 95%, so that the strength-elongation product can be up to 60 GPa %. Although the TWIP steels have developed for nearly ten years, a main reason why the TWIP steels still fail to be accepted by the automobile industry is that the TWIP steels require high manganese content and do not conform to consideration of commercial cost.

To sum up, because the strength-elongation product of the 1st generation AHSSs is too low to meet the requirements for properties of the steels used in automobiles and the manganese alloy content of the 2nd generation AHSSs is too high to meet commercial requirements, the automobile industry has turned to development of 3rd generation AHSSs.

Referring to FIG. 1, which shows a diagram of a location range of target zones of properties of the 3rd generation AHSSs. As shown in FIG. 1, the strength-elongation product of the 3rd generation AHSSs ranges about from 30 GPa % to 50 GPa %.

However, in the automobile industry, a method for manufacturing the 3rd generation AHSSs is still under development. Therefore, it is necessary to provide a method for manufacturing a high-strength and high-ductility steel to manufacture steels in line with or superior to the requirements for properties of the 3rd generation AHSSs.

SUMMARY OF THE INVENTION

In accordance with one aspect of the present disclosure, a method for manufacturing a high-strength and high-ductility steel includes steps in which an alloy steel is provided, wherein the alloy steel includes 3 to 8 wt % of manganese, 2 to 4 wt % of aluminum, 0.1 to 2 wt % of silicon, 0.3 to 0.8 wt % of carbon, and the remaining iron and inevitable impurities. The method continues with step in which the alloy steel is hot rolled, so that the microstructure of the alloy steel includes austenite, bainite and martensite. The method continues with step in which the hot-rolled alloy steel is annealed, so as to decompose bainite and martensite structures of the alloy steel into ferrite and austenite structures. The method continues with step in which the annealed alloy steel is cold rolled. The method continues with step in which the cold-rolled alloy steel is annealed, so as to manufacture a high-strength and high-ductility steel in a phase with 50% to 70% of residual austenite.

In the present disclosure, by use of steel alloy design, rolling control and annealing treatment, a high-strength and high-ductility steel with the tensile strength of 1108 MPa, the elongation of 62% and the strength-elongation product of 69 GPa % can be manufactured, and properties of the steel are evidently superior to the requirements for properties of the 3rd generation AHSSs.

BRIEF DESCRIPTION OF THE DRAWINGS

Aspects of the present disclosure are understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION OF THE INVENTION

It is to be understood that the following disclosure provides many different embodiments or examples, for implementing different features of various embodiments. Specific examples of components and arrangements are described below to simplify the present disclosure. The present disclosure may, however, be embodied in many different forms and should not be construed as being limited to the embodiments set forth herein; rather, these embodiments are provided so that this description will be thorough and complete, and will fully convey the present disclosure to those of ordinary skill in the art. It will be apparent, however, that one or more embodiments may be practiced without these specific details.

It will be understood that singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this invention belongs. It will be further understood that terms; such as those defined in commonly used dictionaries, should be interpreted as having a meaning that is consistent with their meaning in the context of the relevant art and the present disclosure, and will not be interpreted in an idealized or overly formal sense unless expressly so defined herein.

Figure 1:
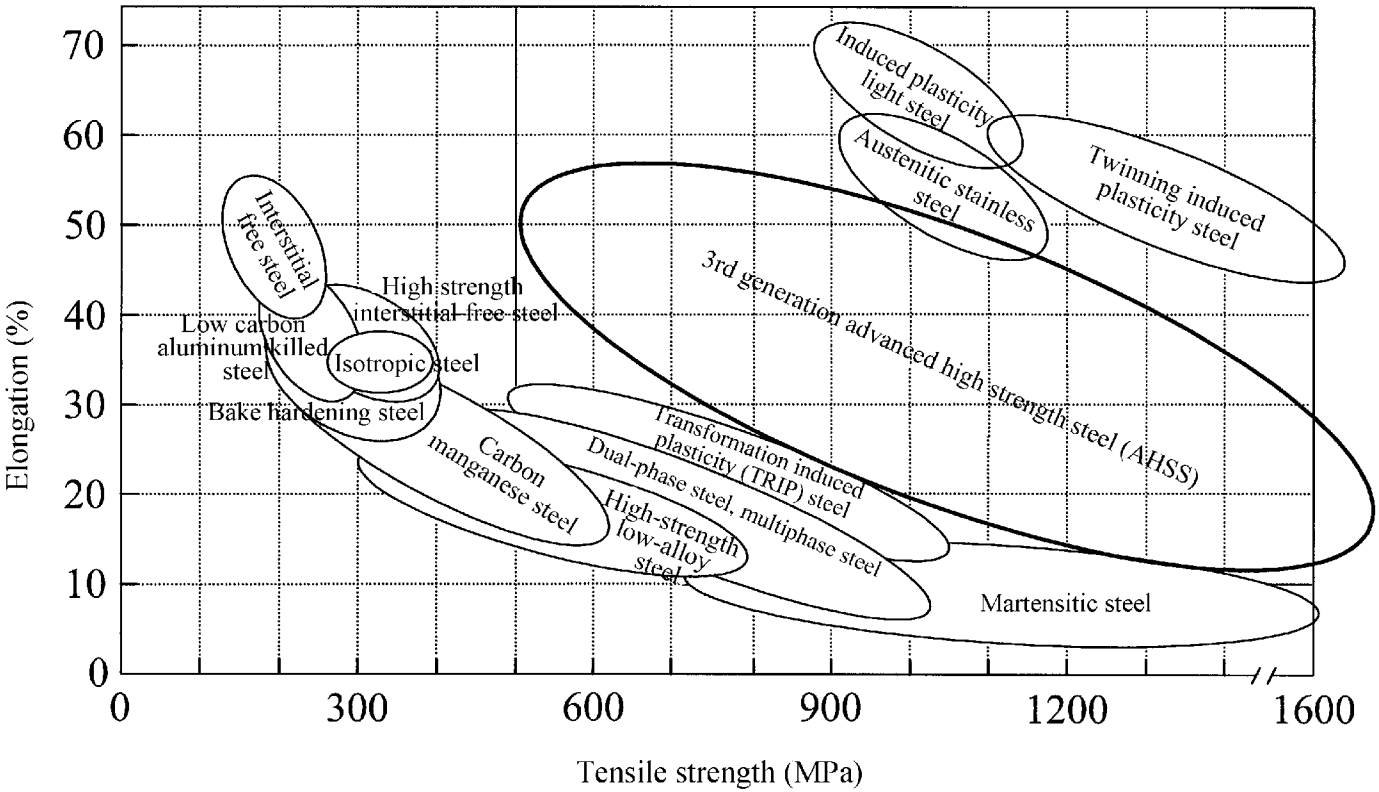
FIG. 1 shows a diagram of a location range of target zones of properties of the 3rd generation AHSSs.
Figure 2:
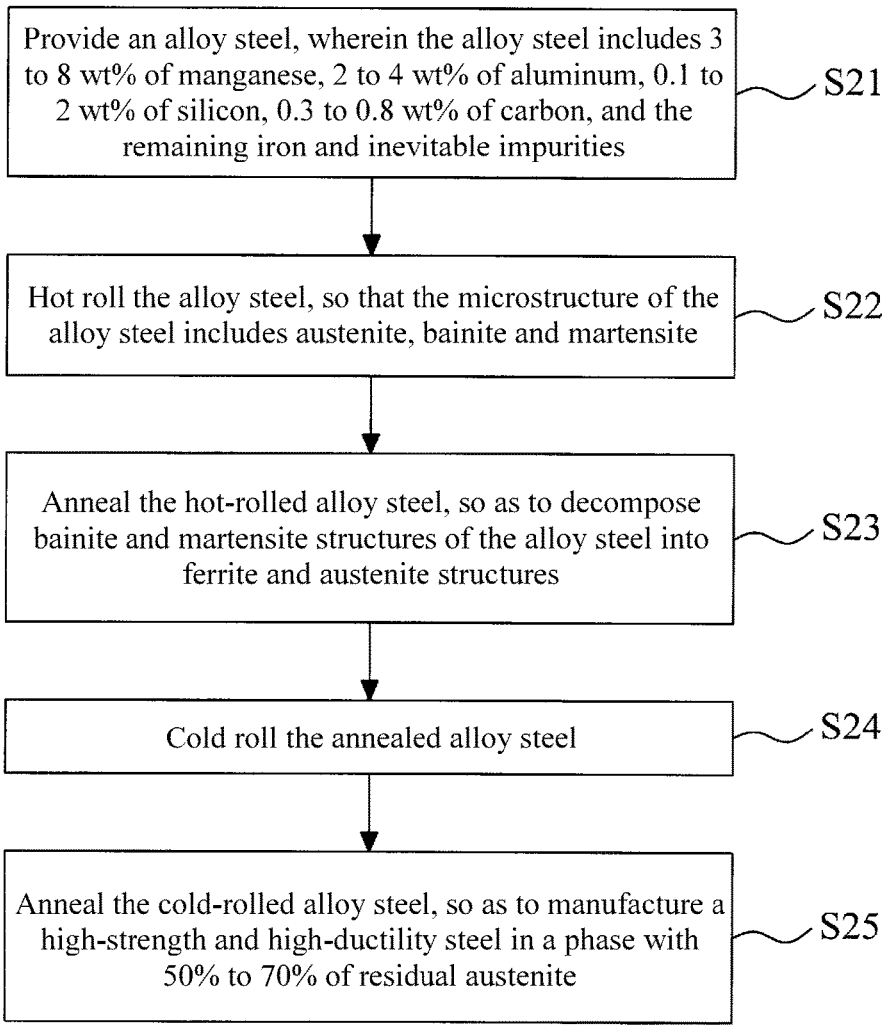
FIG. 2 is a flow diagram of a method for manufacturing a high-strength and high-ductility steel according to the present disclosure.

FIG. 2 is a flow diagram of a method for manufacturing a high-strength and high-ductility steel according to the present disclosure.

Referring to step S21 of FIG. 2, an alloy steel is provided. The alloy steel includes 3 to 8 wt % of manganese, 2 to 4 wt % of aluminum, 0.1 to 2 wt % of silicon, 0.3 to 0.8 wt % of carbon, and the remaining iron and inevitable impurities.

Referring to step S22, the alloy steel is hot rolled, so that the microstructure of the alloy steel includes austenite, bainite and martensite. Preferably, the hot rolling finishing temperature is greater than or equal to 850° C.

Referring to step S23, the hot-rolled alloy steel is annealed, so as to decompose bainite and martensite structures of the alloy steel into ferrite and austenite structures. Preferably, the annealing temperature is 650° C. to 750° C. inclusive, and the annealing time is 30 minutes to 120 minutes inclusive.

In the present disclosure, through the annealing treatment, the alloy steel can have nearly equiaxed fine-grain ferrite, which helps the steel to have uniform deformation and enhanced tensile strength.

Referring to step S24, the annealed alloy steel is cold rolled. Preferably, the cold-rolling reduction rate is 25% to 50% inclusive.

Referring to step S25, the cold-rolled alloy steel is annealed, so as to manufacture a high-strength and high-ductility steel in a phase with 50% to 70% of residual austenite. Preferably, the annealing temperature is 650° C. to 750° C. inclusive, and the annealing time is 30 minutes to 120 minutes inclusive. In addition, the tensile strength (TS) and the elongation (El) of the high-strength and high-ductility steel satisfy the following relations:

$$TS[MPa]=700+(M\times 30)+\{50/(CR\ \%\times 100)\}+(730-T)$$

$$El[\%]=30+(CR\ \%\times 0.6)+\{[(t/30)-1]\times 10\}-|700-T|\times 0.5$$

where M is the manganese content (wt %), CR % is the cold-rolling reduction rate, T is the annealing temperature (° C.), and t is the annealing time (min).

The present disclosure is described in detail with the following embodiments, but this does not mean that the present disclosure is only limited to the content disclosed by the embodiments.

Referring to Table 1, which lists steel experimental results of Embodiments 1 to 5 and Comparative Examples 1 to 2. The cold-rolling reduction rates of Comparative Examples 1 to 2 are 0%, the annealing temperatures thereof are 700° C., and the annealing times thereof are 30 minutes and 60 minutes respectively. The cold-rolling reduction rates of Embodiments 1 to 3 are 25%, the annealing time thereof is 30 minutes, and the annealing temperatures thereof are 650° C., 700° C. and 730° C. respectively. The cold-rolling reduction rates of Embodiments 4 to 5 are 50%, the annealing time thereof is 30 minutes, and the annealing temperatures thereof are 675° C. and 700° C. respectively.

The results in Table 1 show that the tensile strengths (TS) of Comparative Examples 1 to 2 do not reach 1000 MPa, while the tensile strengths (TS) of Embodiments 1 to 5 are all higher than 1000 MPa.

TABLE 1

| Sample code | Cold-rolling reduction rate (%) | Annealing temperature (° C.) | Annealing time (min) | Computed TS (MPa) | Computed El (%) | Actual TS (MPa) | Actual El (%) | Actual strength-elongation product (GPa %) |
|---|---|---|---|---|---|---|---|---|
| Comparative Example 1 | 0 | 700 | 30 | 930 | 30 | 905 | 33 | 30 |
| Comparative Example 2 | 0 | 700 | 60 | 930 | 40 | 902 | 45 | 41 |
| Embodiment 1 | 25 | 650 | 30 | 1180 | 20 | 1205 | 24 | 29 |
| Embodiment 2 | 25 | 700 | 30 | 1130 | 45 | 1150 | 48 | 55 |
| Embodiment 3 | 25 | 730 | 30 | 1100 | 30 | 1109 | 26 | 29 |
| Embodiment 4 | 50 | 675 | 30 | 1055 | 47.5 | 1050 | 35 | 37 |
| Embodiment 5 | 50 | 700 | 30 | 1030 | 60 | 1108 | 62 | 69 |

Figure 3:
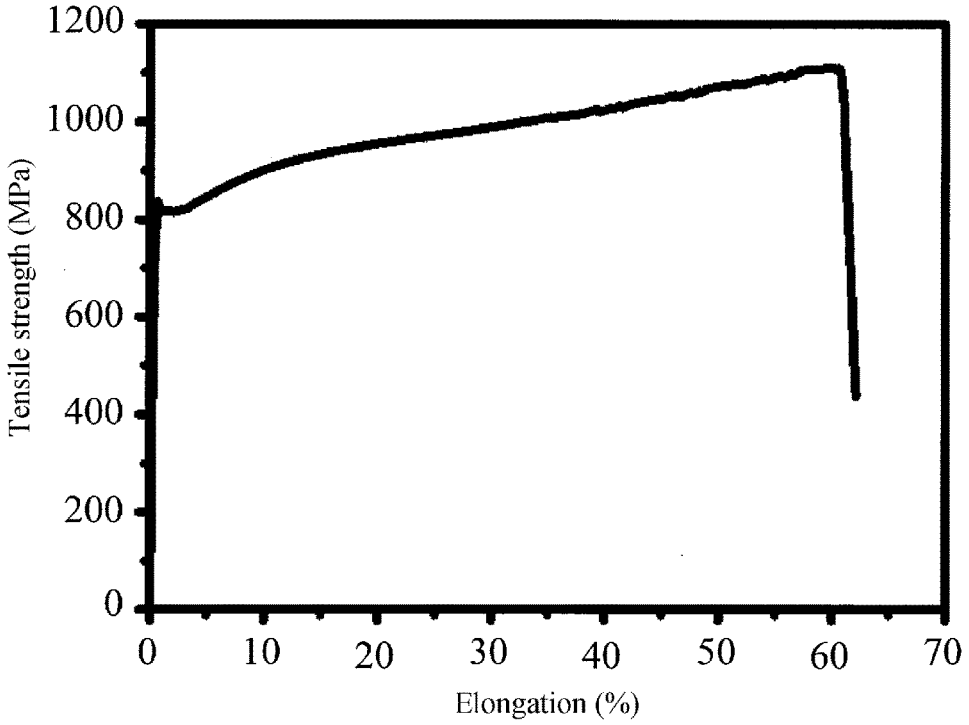
FIG. 3 shows a graph of steel tensile strength-elongation of Embodiment 5.

Referring to FIG. 3, which shows a graph of steel tensile strength-elongation of Embodiment 5. FIG. 3 and the results in Table 1 show that the steel elongation (El) of Embodiment 5 is up to 62%, and the strength-elongation product thereof is up to 69 GPa %, which are evidently superior to the requirements for properties of the 3rd generation AHSSs.

The experimental results prove that high tensile strength, high elongation and high strength-elongation product steels can be manufactured indeed by use of steel alloy design, rolling control and annealing treatment according to the present disclosure.

Moreover, the scope of the present application is not intended to be limited to the particular embodiments of the process, machine, manufacture, and composition of matter, means, methods and steps described in the specification. As those skilled in the art will readily appreciate form the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure.

Accordingly, the appended claims are intended to include within their scope such processes, machines, manufacture, and compositions of matter, means, methods or steps. In addition, each claim constitutes a separate embodiment, and the combination of various claims and embodiments are within the scope of the invention.

What is claimed is:

1. A method for manufacturing a steel, comprising:

(a) providing an alloy steel, wherein the alloy steel includes 3 to 8 wt % of manganese, 2 to 4 wt % of aluminum, 0.1 to 2 wt % of silicon, 0.3 to 0.8 wt % of carbon, and the remaining iron and inevitable impurities;

(b) hot rolling the alloy steel, so that the microstructure of the alloy steel includes austenite, bainite and martensite;

(c) annealing the hot-rolled alloy steel, so as to decompose bainite and martensite structures of the alloy steel into ferrite and austenite structures, wherein the annealing time is 30 minutes to 120 minutes inclusive and the annealing temperature is 650° C. to 700° C.;

(d) cold rolling the annealed alloy steel, wherein the cold-rolling reduction rate is 25%; and (e) annealing the cold-rolled alloy steel, so as to manufacture a steel in a phase with 50% to 70% of residual austenite, wherein the annealing temperature is 650° C. to 700° C.

2. The method of claim 1, wherein the hot rolling finishing temperature of the step (b) is greater than or equal to 850° C.

3. The method of claim 1, wherein the annealing time of the step (e) is 30 minutes to 120 minutes inclusive.

4. The method of claim 1, wherein the tensile strength (TS) and the elongation (El) of the steel of the step (e) satisfy the following relations:

$$TS[MPa]=700+(M\times 30)+\{50/(CR\ \%\times 100)\}+(730-T)$$

$$El[\%]=30+(CR\ \%\times 0.6)+\{[(t/30)-1]\times 10\}-|700-T|\times 0.5$$

where M is the manganese content (wt %), CR % is the cold-rolling reduction rate, T is the annealing temperature (° C.), and t is the annealing time (min).

* * * * *